US007476132B2

(12) United States Patent
Xu

(10) Patent No.: US 7,476,132 B2
(45) Date of Patent: Jan. 13, 2009

(54) DOUBLE-ENDED PRESSURE CONTACTING ELECTRICAL TERMINAL

(75) Inventor: Xiang Xu, Kuns Han (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/579,370

(22) PCT Filed: Nov. 19, 2004

(86) PCT No.: PCT/US2004/039088

§ 371 (c)(1),
(2), (4) Date: Feb. 8, 2007

(87) PCT Pub. No.: WO2005/053106

PCT Pub. Date: Jun. 9, 2005

(65) Prior Publication Data

US 2008/0003888 A1 Jan. 3, 2008

(30) Foreign Application Priority Data

Nov. 20, 2003 (CN) ..... 2003 2 0100682

(51) Int. Cl.
*H01R 13/24* (2006.01)

(52) U.S. Cl. ..... 439/700; 439/66

(58) Field of Classification Search ..... 439/66, 439/700

See application file for complete search history.

(56) References Cited

U.S. PATENT DOCUMENTS

| | | | | |
|---|---|---|---|---|
| 3,416,125 | A * | 12/1968 | Theve | 439/638 |
| 6,159,056 | A * | 12/2000 | Boyle | 439/700 |
| 6,685,492 | B2 * | 2/2004 | Winter et al. | 439/219 |
| 6,758,682 | B1 * | 7/2004 | Kosmala | 439/66 |
| 6,866,519 | B2 * | 3/2005 | Fan et al. | 439/66 |

* cited by examiner

*Primary Examiner*—Truc T Nguyen

(57) ABSTRACT

An electrical terminal (30) includes first (34) and second (36) contact members having outer pressure contacting end portions (34*a*, 36*a*) for pressure engaging first and second electrical devices, respectively, along with enlarged inner end portions (34*b*, 36*b*). The pressure contacting end portion of one contact member is longer than the pressure contacting end portion of the other contact member. A sleeve (32) is provided with a through hole (44) for slidably receiving the inner end portions of the first and second contact members. The through hole has opposite open ends (44*a*, 44*b*) through which the pressure contacting end portions of the contact members project. A biasing member (38) is disposed in the through hole to resiliently bias the contact members in opposite directions.

14 Claims, 3 Drawing Sheets

DOUBLE-ENDED PRESSURE CONTACTING ELECTRICAL TERMINAL

FIELD OF THE INVENTION

This invention generally relates to the art of electrical connectors and, particularly, to a pressure-contacting electrical terminal for electrically coupling a pair of electrical devices.

BACKGROUND OF THE INVENTION

As is known in the art, pressure contacting electrical terminals are used to form a conductive circuit between two electrical devices by pressure engagement therebetween, such as establishing a connection between a mobile phone and an antenna. During assembly, one end of the terminal first is pressure engaged with a first electrical device, and an opposite end of the terminal then is pressure engaged with the second electrical device, thereby establishing an electrical connection between the two electrical devices.

For instance, FIG. 1 shows a prior art electrical terminal, generally designated 10, of the character described above. The terminal includes a sleeve or housing 12 having an inner conductive liner 14 forming a through hole 16 through the housing. The through hole has opposite open ends 18. A pair of contact members 20 have outer pressure contacting end portions 20*a* and enlarged inner end portions 20*b*. The inner end portions are reciprocally mounted within through hole 16, while outer end portions 20*a* project through openings 18 and outwardly of the housing. A coil spring 22 is disposed within through hole 16 and has opposite ends in engagement with the enlarged inner end portions 20*b* of contact members 20 to bias the contact members in opposite directions. It can be seen that the outer pressure contacting end portions 28*a* of contact members 20 have identical lengths, as indicated by double-headed arrows 24. In other words, the outer end portions of the contact members project from opposite ends of housing 12 the same distances.

It has been found that in some applications, the restricted or narrow distance between the two electrical devices which are to be electrically connected by terminal 10 makes it difficult to assemble terminal 10 between the electrical devices, because of the equal distances which contact members 20 project from opposite ends of housing 12. In other words, the total distance between the distal ends of outer end portions 20*a* of the contact members is excessive in comparison to the distance between the two, spaced electrical devices, and this makes it difficult to assemble the terminal between the devices. The present invention is directed to solving these problems and providing improvements in pressure-contacting electrical terminals of the character described.

SUMMARY OF THE INVENTION

An object, therefore, of the invention is to provide a new and improved electrical terminal of the character described.

In the exemplary embodiment of the invention, the electrical terminal includes first and second contact members having an outer pressure contacting end portions for pressure engaging first and second electrical devices, respectively, along with enlarged inner end portions. The pressure contacting end portion of one contact member is longer than the pressure contacting end portion of the other contact member. A sleeve is provided with a through hole for slidably receiving the inner end portions of the first and second contact members. The through hole has opposite open ends through which the pressure contacting end portions of the contact members project. A biasing member is disposed in the through hole to resiliently bias the contact members in opposite directions.

As disclosed herein, the outer pressure contacting end portions of the contact members have rounded convex contact surfaces for engaging the electrical devices. The biasing member comprises a coil spring having opposite ends engageable with the enlarged inner end portions of the contact members.

The sleeve includes an inner tube surrounded by an outer tube. The enlarged inner end portions of the contact members are reciprocally slidably mounted in opposite ends of the inner tube which, preferably, is fabricated of conductive material.

Restricted stop means are provided at the open ends of the through hole for abutting the enlarged inner ends of the contact members to define outer limit positions of the pressure contacting end portions of the contact members. The restricted stop means at one open end of the sleeve is formed by an inwardly turned flange of the outer tube. The restricted stop means at the opposite end of the sleeve is formed by an inwardly turned flange of the inner tube.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
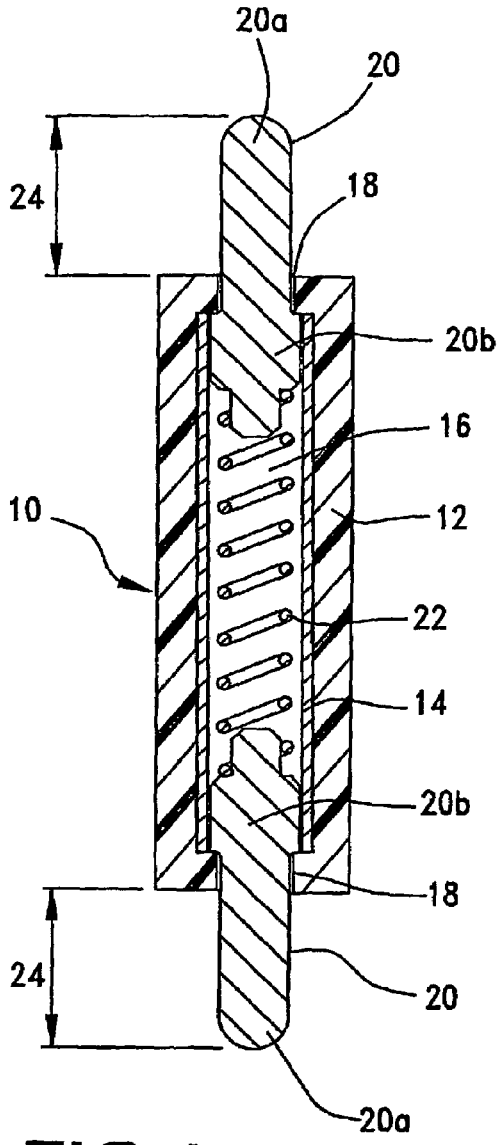
FIG. 1 (PRIOR ART)
FIG. 1 is a longitudinal or axial section through an electrical terminal according to the prior art and as described in the Background, above.
Figure 4:
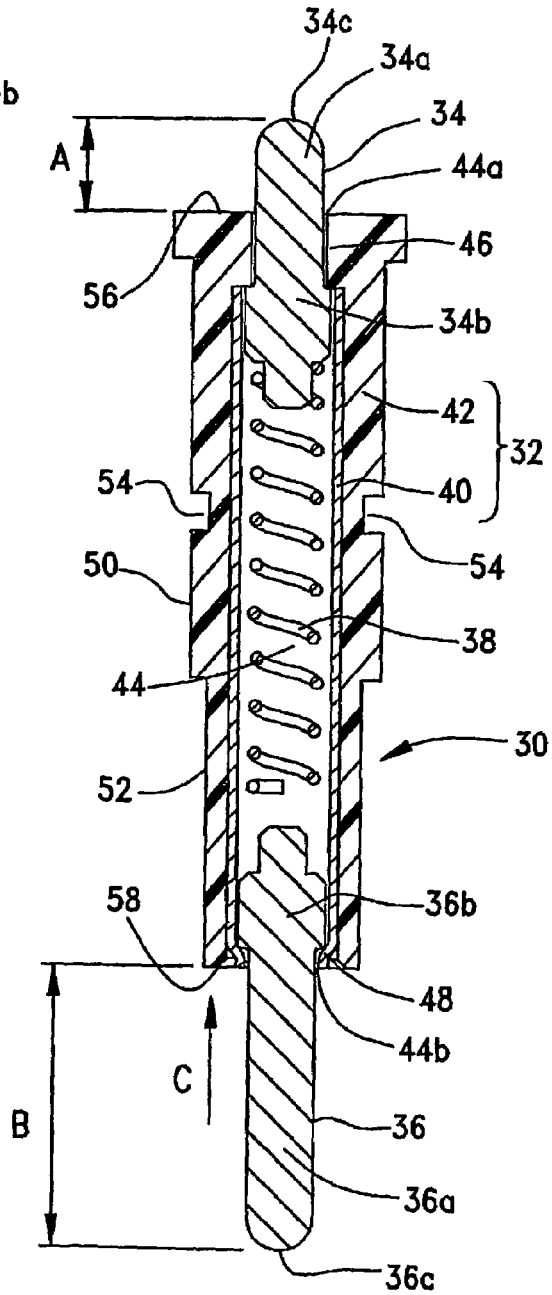
FIG. 4 is a longitudinal or axial section through the terminal of the first embodiment.
Figure 2:
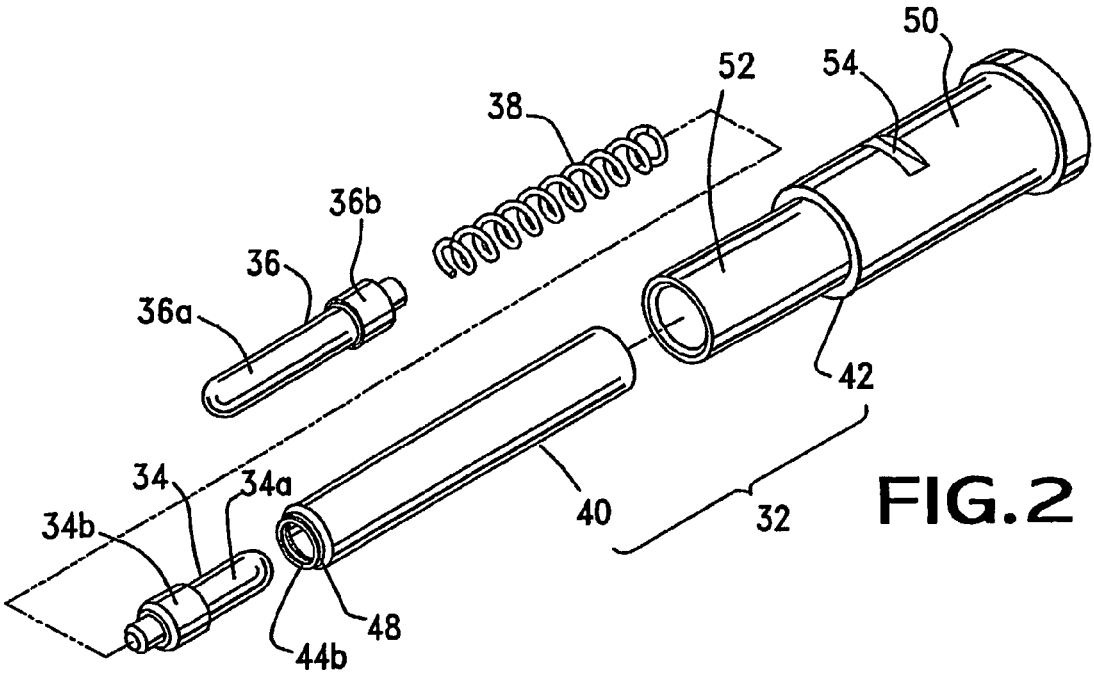
FIG. 2 is an exploded perspective view of an electrical terminal according to a first embodiment of the invention.
Figure 3:
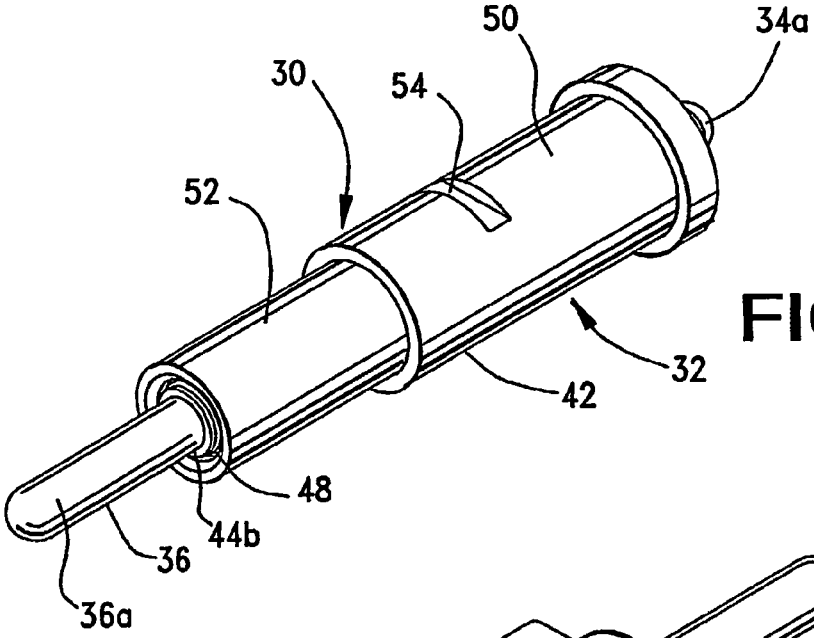
FIG. 3 is a perspective view of the terminal of FIG. 1 in assembled condition.

Referring to the drawings in greater detail, and first to FIGS. 2-4, an electrical terminal, generally designated 30, is shown according to a first embodiment of the invention. Generally, the terminal includes a sleeve 32, a first contact member 34, a second contact member 36 and a coil spring 38 within the sleeve and compressed to resiliently bias the contact members in opposite directions. According to the invention and as described hereinafter, it can be seen that second contact member 36 is longer than first contact member 34. The two contact members are fabricated of conductive material such as metal.

More particularly, first contact member 34 of terminal 30 includes an outer pressure contacting end portion 34*a* for pressure engaging a first electrical device. The first contact member includes an enlarged inner end portion 34*b*. The distal end of outer end portion 34*a* is dome shaped to present a rounded convex contacting surface 34*c* for pressure engaging the first electrical device.

Second contact member 36 of terminal 32 includes an outer pressure contacting end portion 36*a* for pressure engaging a second electrical device. The second contact member includes an enlarged inner end portion 36*b*. The distal end of outer end portion 36*a* is dome shaped to present a rounded convex contacting surface 36*c* for pressure engaging the second electrical device.

Sleeve 32 of terminal 30 includes an inner tube 40 surrounded by an outer tube 42. The outer tube may be fabricated of dielectrical material such as plastic, while the inner tube is fabricated of metal material. A through hole 44 extends longitudinally or axially through the sleeve within inner tube 40. The through hole has a first open end 44*a* through which outer end portion 34*a* of first contact member 34 projects. The sleeve has a second open end 44*b* through which outer end portion 36*a* of second contact member 36 projects.

Generally, restricted stop means are provided at the open ends of through hole 44 for abutting the enlarged inner end portions 34*b* and 36*b* of the contact members to define outer limit positions of the pressure contacting end portions 34*a* and 36*a* of the contact members. Specifically, a restricted stop is formed by an inwardly turned flange 46 at one end of outer tube 42 of sleeve 32 and against which inner end portion 34*b* of first contact member 34 abuts under the biasing of coil spring 38. A restricted stop is formed by an inwardly turned flange 48 at one end of inner tube 40 of sleeve 32 and against which the enlarged inner end portion 36*b* of second contact member 36 abuts under the biasing of coil spring 38.

As best seen in FIG. 2, both the inner tube 40 and the outer tube 42 of sleeve 32 are circular in cross-section. The outer tube has a cylindrical outer wall 50 of a given diameter and includes an outer wall section 52 of a reduced diameter. Outer wall 50 includes a pair of positioning notches 54 in opposite sides thereof for positioning the terminal in an electrical device.

As seen best in FIG. 4, the invention contemplates that first and second contact members 34 and 36, respectively, have outer pressure contacting end portions 34*a* and 36*a*, respectively, of different lengths. This enables the terminal to be positioned between a pair of electrical devices which have a restricted spacing therebetween.

More particularly, it can be seen in FIG. 4 that outer end portion 34*a* of first contact member 34 has a given length so that it projects a given distance from a first end 56 of sleeve 32. This given distance is indicated by double-headed arrow "A". On the other hand, it can be seen that outer end portion 36*a* of second contact member 36 is significantly longer than the outer end portion of the first contact member. Therefore, the outer end portion of the second contact member projects from a second end 58 of sleeve 32 a longer distance as indicated by double-headed arrow "B".

The advantages of providing contact members 34 and 36 with different lengths is that terminal 30 can be positioned in pressure engagement with an electrical device by engaging second contact member 36 with the electrical device and pushing the second contact member into sleeve 32 in the direction of arrow "C" (FIG. 4) a significant distance because of the longer length of outer end portion 36*a* of the second contact member. The outer end portion 34*a* of first contact member 34 then can be positioned in pressure engagement with the other of two electrical devices having limited spacing, because the outer end portion of the first contact member projects from sleeve 32 a minimal distance "A". Yet, the overall length of terminal 30 is not changed. In other words, the "operative" or compressed length of terminal 30 is reduced with a given length for sleeve 32 to accommodate more narrowly spaced electrical devices. If the length of first contact member 34 was the same length "B" as second contact member 36, this would not be possible.

Figure 6:
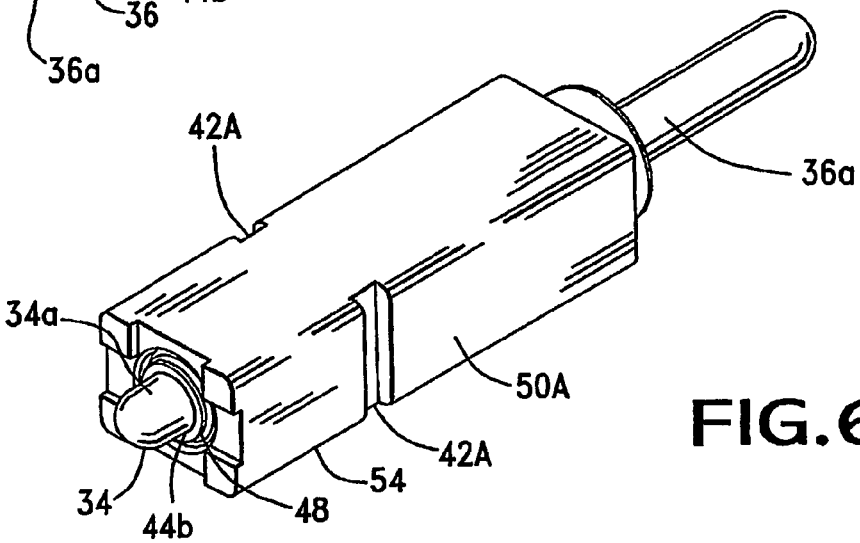
FIGS. 5-7 are views similar to that of FIGS. 2-4, but of a second embodiment of the invention.
Figure 5:
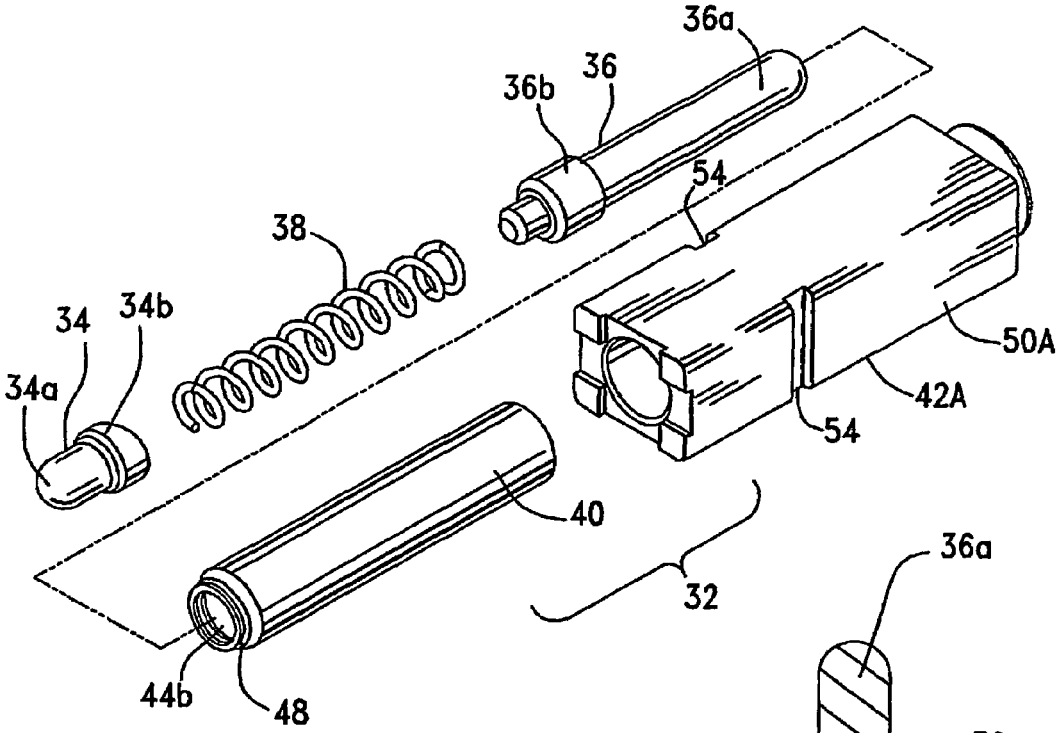
Figure 7:
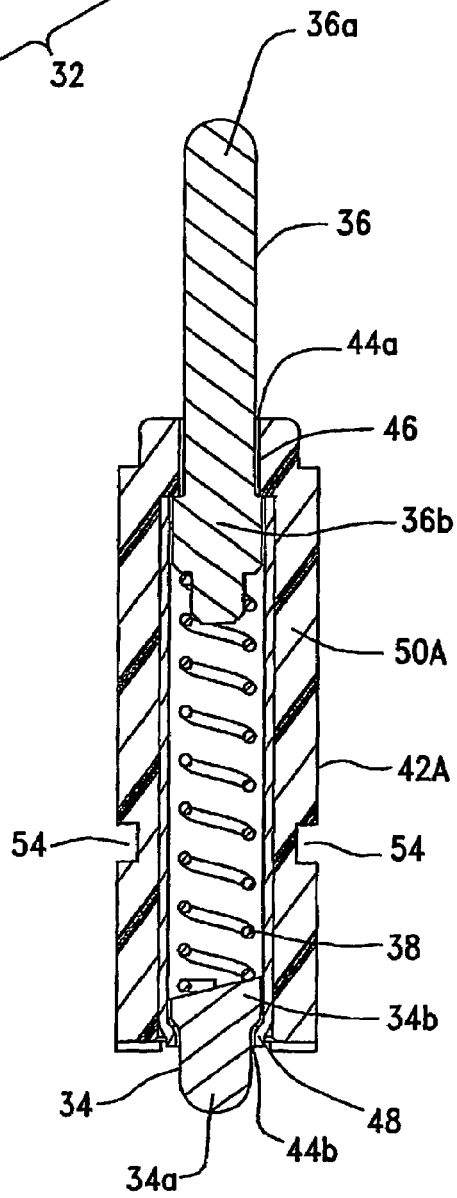

FIGS. 5-7 show a second embodiment of the invention which differs from the first embodiment of FIGS. 2-4 in the cross-sectional shape of the outer tube of sleeve 32. Therefore, like reference numerals have been applied in FIGS. 5-7 corresponding to like components described above in relation to the first embodiment of FIGS. 2-4. In addition, the description of those like components have not been repeated.

More particularly, it can be seen in FIGS. 5 and 6 that inner tube 40 of sleeve 32 is cylindrical as in the first embodiment. However, outer tube 42A is rectangular in cross-section to define a generally rectangular outer wall 50A. The outer wall is of uniform cross-sectional dimensions along the entire length of the outer tube. Again, positioning notches 54 are formed at opposite sides of the outer tube.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

The invention claimed is:

1. An electrical terminal, comprising:

a first contact member having an outer pressure contacting end portion for pressure engaging a first electrical device and an enlarged inner end portion, the pressure contacting end portion having a given length;

a second contact member having an outer pressure contacting end portion for pressure engaging a second electrical device and an enlarged inner end portion, the pressure contacting end portion having a length greater than a length of the pressure contacting end portion of the first contact member;

a sleeve including an inner tube, fabricated of a conductive material, surrounded by an outer tube, fabricated of a dielectric material, with the enlarged inner end portions of the contact members being reciprocally slidably mounted in opposite ends of the inner tube, a through hole for slidably receiving the inner end portions of the first and second contact members, said through hole having first and second open ends, restricted stop means for each contact member for abutting the enlarged inner ends of the contact members to define outer limit positions of the pressure contacting end portions of the contact members;

a biasing member in the through hole of the housing to resiliently bias the contact members in opposite directions; and said pressure contacting end portions being defined as those parts of the contact members which project beyond opposite ends of the sleeve when the enlarged inner end portions abut the restricted stop means.

2. The electrical terminal of claim 1 wherein said biasing member comprises a coil spring having opposite ends engageable with the enlarged inner end portions of the contact members.

3. The electrical terminal of claim 1 wherein one of said restricted stop means is positioned at one open end of the sleeve and is formed by an inwardly turned flange of the inner tube.

4. The electrical terminal of claim 1 wherein the outer pressure contacting end portion of said first contact member has a rounded convex contact surface for engaging the first electrical device.

5. The electrical terminal of claim 1 wherein the outer pressure contacting end portion of said second contact member has a rounded convex contact surface for engaging the second electrical device.

6. The electrical terminal of claim 5 wherein the outer pressure contacting end portion of said first contact member has a rounded convex contact surface for engaging the first electrical device.

7. An electrical terminal, comprising:

a first contact member having an outer pressure contacting end portion for pressure engaging a first electrical device and an enlarged inner end portion, the pressure contacting end portion having a given length;

a second contact member having an outer pressure contacting end portion for pressure engaging a second electrical device and an enlarged inner end portion, the pressure contacting end portion having a length greater than a length of the pressure contacting end portion of the first contact member;

a sleeve including an inner tube, fabricated of a conductive material, surrounded by an outer tube, fabricated of a dielectric material, with the enlarged inner end portions of the contact members being reciprocally slidably mounted in opposite ends of the inner tube, a through hole for slidably receiving the inner end portions of the first and second contact members, said through hole having first and second open ends, restricted stop means at the open ends of the through hole for abutting the enlarged inner ends of the contact members to define outer limit positions of the pressure contacting end portions of the contact members;

a biasing member in the through hole of the housing to resiliently bias the contact members in opposite directions; and said pressure contacting end portions being defined as those parts of the contact members which project beyond the open ends when the enlarged inner end portions abut the restricted stop means;

wherein said restricted stop means at one open end of the sleeve is formed by an inwardly turned flange of the outer tube.

8. An electrical terminal, comprising:

a first contact member having an outer pressure contacting end portion for pressure engaging a first electrical device and an enlarged inner end portion, the pressure contacting end portion having a given length;

a second contact member having an outer pressure contacting end portion for pressure engaging a second electrical device and an enlarged inner end portion, the pressure contacting end portion having a length greater than a length of the pressure contacting end portion of the first contact member;

a sleeve including an inner tube, fabricated of a conductive material, surrounded by an outer tube, fabricated of a dielectric material, with the enlarged inner end portions of the contact members being reciprocally slidably mounted in opposite ends of the inner tube, a through hole for slidably receiving the inner end portions of the first and second contact members, said through hole having first and second open ends, restricted stop means at the open ends of the through hole for abutting the enlarged inner ends of the contact members to define outer limit positions of the pressure contacting end portions of the contact members;

a biasing member in the through hole of the housing to resiliently bias the contact members in opposite directions; and said pressure contacting end portions being defined as those parts of the contact members which project beyond the open ends when the enlarged inner end portions abut the restricted stop means;

wherein said restricted stop means at one open end of the sleeve is formed by an inwardly turned flange of the inner tube and said restricted stop means at the opposite open end of the sleeve is formed by an inwardly turned flange of the outer tube.

9. An electrical terminal, comprising:

a first contact member having an outer pressure contacting end portion for pressure engaging a first electrical device and an enlarged inner end portion, the pressure contacting end portion having a given length;

a second contact member having an outer pressure contacting end portion for pressure engaging a second electrical device and an enlarged inner end portion, the pressure contacting end portion having a length greater than a length of the pressure contacting end portion of the first contact member;

a sleeve including an inner tube, fabricated of a conductive material, surrounded by an outer tube, fabricated of a dielectric material, with the enlarged inner end portions of the contact members being reciprocally slidably mounted in opposite ends of the inner tube, a through hole for slidably receiving the inner end portions of the first and second contact members, said through hole having first and second open ends, restricted stop means at the open ends of the through hole for abutting the enlarged inner ends of the contact members to define outer limit positions of the pressure contacting end portions of the contact members;

a biasing member in the through hole of the housing to resiliently bias the contact members in opposite directions; and said pressure contacting end portions being defined as those parts of the contact members which project beyond the open ends when the enlarged inner end portions abut the restricted stop means;

wherein said restricted stop means at one open end of the sleeve is formed by an inwardly turned flange of the inner tube; said restricted stop means at the opposite open end of the sleeve is formed by an inwardly turned flange of the outer tube and one end of the inner tube abuts against the inwardly turned flange of the outer tube.

10. An electrical terminal, comprising:

a first contact member having an outer pressure contacting end portion for pressure engaging a first electrical device and an enlarged inner end portion, the pressure contacting end portion having a given length;

a second contact member having an outer pressure contacting end portion for pressure engaging a second electrical device and an enlarged inner end portion, the pressure contacting end portion having a length greater than a length of the pressure contacting end portion of the first contact member;

a sleeve including an inner tube fabricated of conductive material and an outer tube fabricated of dielectric material, a through hole in the inner tube for slidably receiving the inner end portions of the first and second contact members at opposite ends of the inner tube, said through hole having first and second open ends through which the pressure contacting end portions of the first and second contact members project, a restricted stop at the open end of the through hole formed by an inwardly turned flange of the outer tube for abutting the enlarged inner end of one of the contact members to define an outer limit positions of the pressure contacting end portion of the one contact member, and a restricted stop at the opposite open end of the through hole formed by an inwardly turned flange of the inner tube for abutting the enlarged inner end portion of the other contact member to define an outer limit position of the pressure contacting end portion of the other contact member; and a coil spring in the through hole and having opposite ends engageable with the enlarged inner end portions of the contact members to resiliently bias the contact members in opposite directions.

11. The electrical terminal of claim 10 wherein one end of the inner tube abuts against the inwardly turned flange of the outer tube.

12. The electrical terminal of claim 10 wherein the outer pressure contacting end portion of said first contact member has a rounded convex contact surface for engaging the first electrical device.

13. The electrical terminal of claim 10 wherein the outer pressure contacting end portion of said second contact member has a rounded convex contact surface for engaging the second electrical device.

14. The electrical terminal of claim 13 wherein the outer pressure contacting end portion of said first contact member has a rounded convex contact surface for engaging the first electrical device.

* * * * *